US006893215B2

(12) United States Patent
Kuwabara et al.

(10) Patent No.: US 6,893,215 B2
(45) Date of Patent: May 17, 2005

(54) DIVISION WALL AND SHROUD OF GAS TURBINE

(75) Inventors: Masamitsu Kuwabara, Hyogo (JP); Yoshiyuki Morii, Hyogo (JP); Yasuoki Tomita, Hyogo (JP); Shunsuke Torii, Hyogo (JP); Shigehiro Shiozaki, Hyogo (JP); Kotaro Ohshima, Hyogo (JP); Tatsuaki Fujikawa, Hyogo (JP); Ryotaro Magoshi, Hyogo (JP); Shinichi Inoue, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 134 days.

(21) Appl. No.: 10/025,593

(22) Filed: Dec. 26, 2001

(65) Prior Publication Data

US 2002/0090296 A1 Jul. 11, 2002

(30) Foreign Application Priority Data

Jan. 9, 2001 (JP) ..... 2001-001950

(51) Int. Cl.[7] ..... F01D 25/26

(52) U.S. Cl. ..... 415/139; 415/115; 416/193 A; 416/190

(58) Field of Search ..... 415/139, 138.1, 415/193 A, 115, 116; 416/193 A, 190, 191, 248

(56) References Cited

U.S. PATENT DOCUMENTS 5,058,906 A 10/1991 Adamek et al.

5,975,844 A 11/1999 Milazar et al.

FOREIGN PATENT DOCUMENTS

| | | | |
|---|---|---|---|
| EP | 0 357 984 | | 3/1990 |
| EP | 0 490 522 | | 6/1992 |
| JP | 60-1471 | | 1/1985 |
| JP | 60-22002 | * | 2/1985 |
| JP | 61-164003 | | 7/1986 |
| JP | 11-125102 | | 5/1999 |
| JP | 2961091 | | 7/1999 |
| JP | 2000-062492 | | 2/2000 |
| WO | WO 00/70191 | | 11/2000 |

* cited by examiner

*Primary Examiner*—Edward K. Look
*Assistant Examiner*—James M McAleenan
(74) *Attorney, Agent, or Firm*—Oblon, Spivak, McClelland, Maier & Neustadt, P.C.

(57) ABSTRACT

The division wall is made up of a plurality of division wall sections forming a passage wall of high temperature gas which are connected in the direction of arrangement of blades to form a wall surface having a roughly circular cross section as a whole, a gas flow restricting structure for preventing high temperature gas from passing through a gap formed at a connecting portion between the division wall sections in the flow direction of the high temperature gas from the opening on the upstream side of the high temperature gas in the gap, or a gas flow restricting structure for preventing the high temperature gas from being embraced in the gap, for example, a sealing member formed into a prism having a T-shape cross section as a whole composed of a plane portion as a sealing portion and a projected portion for filling the gap is provided.

8 Claims, 11 Drawing Sheets

CROSS SECTION ALONG LINE I-I

DIVISION WALL AND SHROUD OF GAS TURBINE

FIELD OF THE INVENTION

The present invention relates to a division wall and a shroud of a gas turbine. More specifically, this invention relates to a division wall of a gas turbine which makes improvement to flow of high temperature gas at a platform of a moving blade or a shroud of a stationary blade, and a division ring surrounding the periphery of the moving blade.

BACKGROUND OF THE INVENTION

A turbine part of a gas turbine used for a generator or the like comprises a moving blade member which rotates together with a rotor and a stationary blade member fixed in_a compartment, the moving blade member consisting of a platform to be connected with the rotor and a moving blade, the stationary blade member consisting of a stationary blade, and an inner shroud and an outer shroud fixed to each end of the stationary blade.

A blade surface of the stationary blade and the inner and the outer shrouds form a passage wall for high temperature gas flowing through the turbine part, and also a blade surface of the moving blade and the platform form a passage wall for high temperature gas. Furthermore, in the compartment, a division ring forming a passage wall for high temperature gas together with the blade surface of the moving blade and the platform is fixed while interposing a certain space between a tip end of the moving blade. The provision ring is formed of a plurality of division ring sections that are connected in the direction of arrangement of moving blade, and forms a wall surface of a circular ring cross section as a whole.

On the other hand, also the moving blade and the stationary blade are divided into a plurality of sections in the peripheral direction of the rotor for the reason of performance such as for absorbing heat deformation, for the reason of manufacture, for the reason of maintainability and the like, and a plural number of shroud sections and platform sections are connected in the direction of arrangement of blade in the same manner as the division ring to formal wall surface having a roughly circular cross section as a whole.

When the shroud sections, platform sections and division ring sections are, respectively connected in the peripheral direction of the rotor, it is necessary to previously keep a gap between the connected shroud sections, between the connected platform sections, between the connected division ring sections. This is because the shroud sections, platform sections and division ring sections will expand by heat in also the peripheral direction due to exposure to high temperature gas, and it is desired to design so that these gaps will completely disappear in the state that these sections expand by heat.

In other words, in the condition that high temperature gas flows through the passage formed by the blade surface, shroud, platform or division ring, the high temperature gas will leak outside from the gap formed between the connected shroud sections and the like, which may cause decrease in turbine efficiency, or occurrence of unexpected failure due to deposition of soil by the high temperature gas which is burned gas.

However, in practice, it is impossible to make the gap completely disappear under high temperature, in consideration of allowance in production and the like. For this reason, in a conventional approach, for example, as is the case of a platform 43 shown in FIG. 10, a sealing member 45 is provided across the platforms 43 to be connected with each other, thereby preventing high temperature gas V1 from leaking outside a gap 44. Such a sealing member 45 is also provided between the shroud sections and between the division ring sections.

In this way, although the high temperature gas V1 is prevented from leaking outside by means of the sealing member 45, the gap 44 between the sections to be connected still exists, so that there is a possibility that the high temperature gas V1 passes through the gap 44 from an opening 44*a* of the gap 44 on the upstream side of the flow direction of the high temperature gas V1 and burns the surface of the gap 44, i.e., a side end surface 43*a* of the division wall section of the platform 43 and the like. Furthermore, there is a possibility that regardless of the position in the flow direction of the high temperature gas V1, the high temperature gas V1 is embraced in the gap 44 to burn the side end surface 43*a* of the division wall section.

SUMMARY OF THE INVENTION

It is an object of the present invention to provide a division wall of a gas turbine which suppresses burning of a side end surface of a division wall section of a platform or the like.

According to the research made by the inventors of the present application, as shown in FIG. 11, a burnt trace due to passage of the high temperature gas V1 is observed in the vicinity of a front end portion 49*a* of an outer shroud 49 of a stationary blade 47 positioned on the back side of a moving blade 42, and it is requested to prevent this part from being burned.

It is an another object of the present invention to provide a shroud of a gas turbine which prevents a front end portion of an outer shroud from being burned.

The division wall of a gas turbine according to one aspect of this invention is made up of a plurality of division wall sections connected in the direction of arrangement of blade of the gas turbine and forms a wall surface having a roughly circular cross section as a whole, the division wall section being fixed to an outer end or an inner end of a respective blade of the gas turbine, or being arranged while interposing a predetermined space between the outer end of the respective blade to form a passage wall for high temperature gas together with a blade surface of the respective blade. This division wall further comprises, a gas flow restricting structure which prevents the high temperature gas from passing through a gap formed at a connecting portion between the division wall sections in a flow direction of the high temperature gas from an opening on the upstream side of the high temperature gas in the gap.

In this context, the division wall section means an individual divided shroud of a moving blade, platform of a moving blade, and division ring, and the division wall means an entire shroud, an entire platform and an entire division ring obtained by connecting the individual divided shrouds and the like.

The shroud of a gas turbine according to an another aspect of this invention is a shroud in which a division ring is provided in a compartment while interposing a certain space between a tip end of a moving blade of the gas turbine, a stationary blade is provided on the back side of the moving blade, and a cooling air passage for cooling the division ring is formed in the division ring. This shroud is characterized in that a front end portion of the shroud opposing to an opening of the back side of the cooling air passage is formed at an angle so that an air film is formed in the front end portion by the cooling air blown from the opening.

Conventionally, a cooling air passage is formed in the division ring for allowing passage of the cooling air for cooling the division ring, the division ring is cooled by heat transfer by allowing the cooling air to communicate in the passage, and the air after cooling is discharged into the passage of high temperature gas from the opening on the downstream side of the flow direction of the high temperature gas, that is the opening opposing to the shroud of the stationary blade provided on the back side of the moving blade. In such a case, this discharged cooling air is utilized for protecting the shroud from the heat of the high temperature gas.

That is, according to the shroud of the present invention, since the front endportion of the shroud is formed at an angle, the cooling air discharged from the opening of the cooling air passage of the division ring will not come into collision with the front end portion of the shroud but flow along the inclined front end portion of the shroud to form a protecting film at this front end portion, thereby protecting from the heat of the high temperature gas and preventing burning.

Other objects and features of this invention will become apparent from the following description with reference to the accompanying drawings.

DETAILED DESCRIPTIONS

Embodiments of a division wall of a gas turbine and a shroud of a gas turbine according to the present invention will be explained in detail below with reference to the accompanying drawings. It is noted that the present invention is not limited to the embodiments described below.

Figure 1:
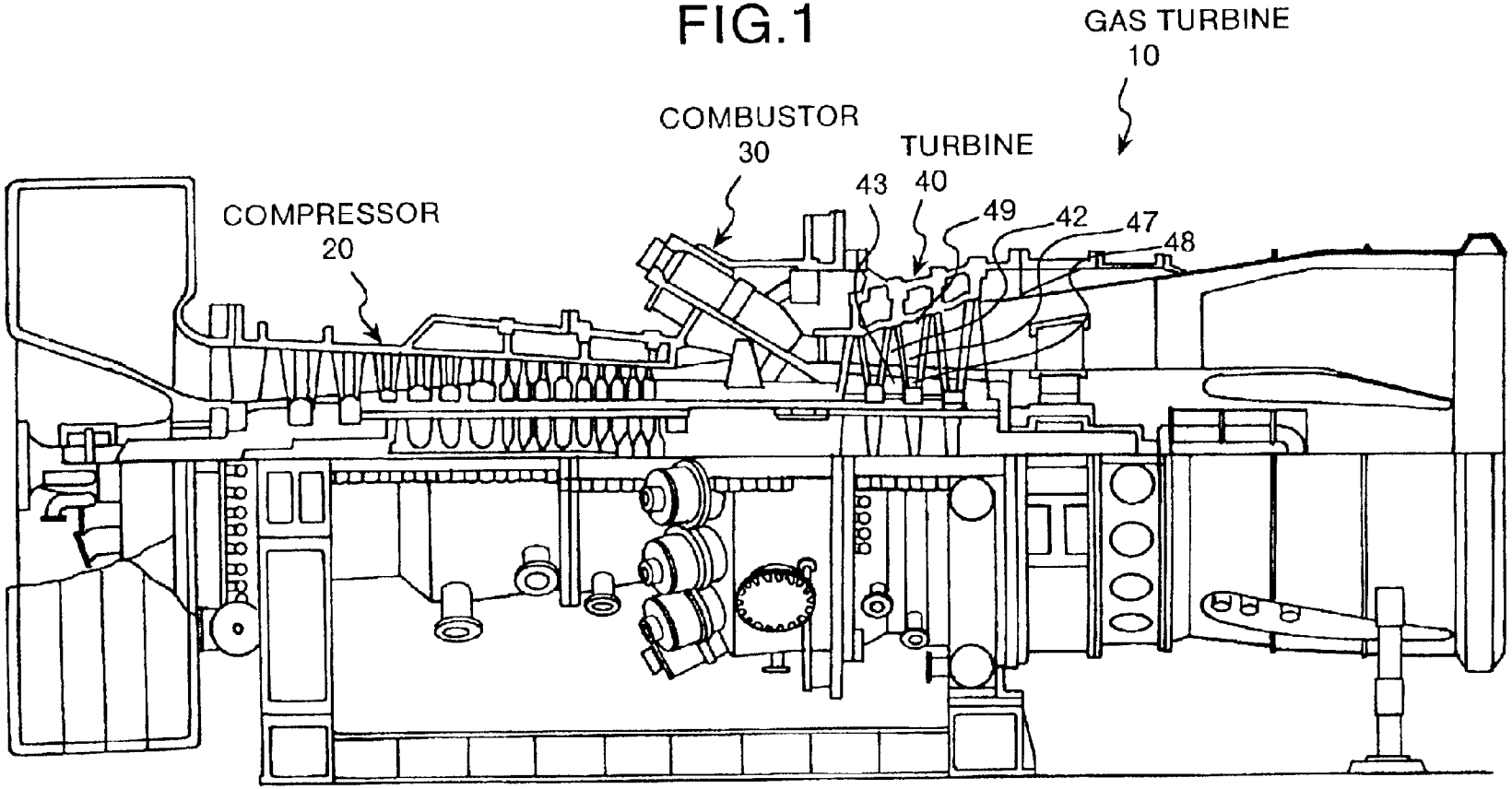
FIG. 1 is a half section view showing the whole of the gas turbine to which a platform according to a first embodiment of the present invention is to be applied.

FIG. 1 is a partial longitudinal section of the whole of a gas turbine 10 for explaining a division wall of a gas turbine which is a first embodiment of the present invention, and this gas turbine 10 comprises a compressor 20 for compressing introduced air, a combustor 30 for splaying fuel to the compression air obtained by being compressed by the compressor 20 to generate burned gas of high temperature (high temperature gas) and a turbine 40 for generating rotation driving force by the high temperature gas generated by the combustor 30. The gas turbine 10 has a cooler (not shown) for extracting part of the compression air in the course of the compressor 20 and discharging the extracted compression air to a moving blade 42, a stationary blade 47 and a moving blade platform 43 of the turbine 40, and to an inner shroud 48 and an outer shroud 49 of the stationary blade 47, respectively.

Figure 2:
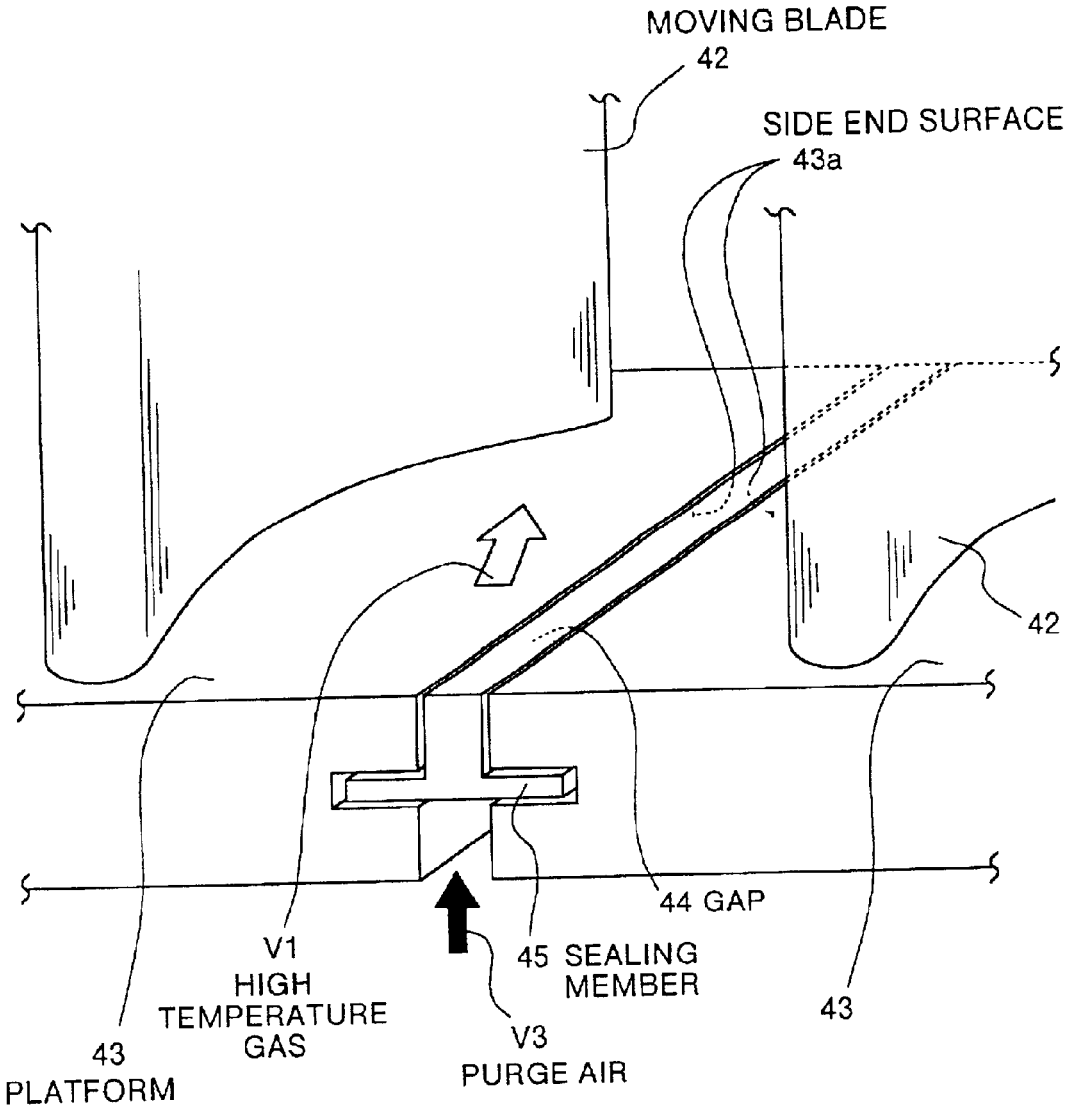
FIG. 2 is a view showing a platform which is the first embodiment of the present invention.

A moving blade member of the turbine 40 consists of, as shown in FIG. 2, the moving blade 42 and the platform 43 fixed to the inside end of the moving blade, and this moving blade member is connected in plural about the axis of the turbine so that the moving blade 42 is arranged about the axis as a whole.

Figure 10:
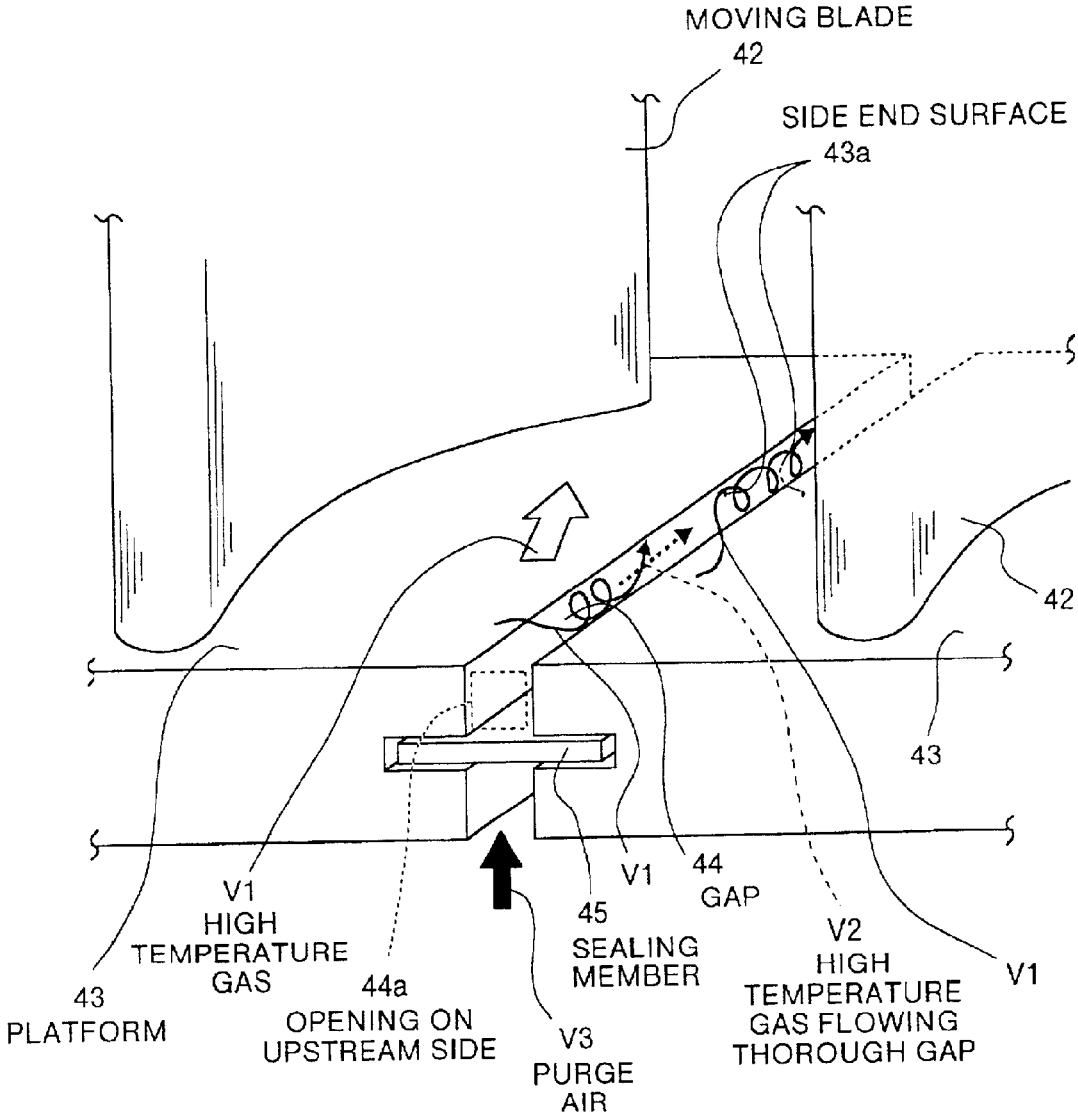
FIG. 10 is a view showing a platform of a gas turbine according to the prior art.
Figure 11:
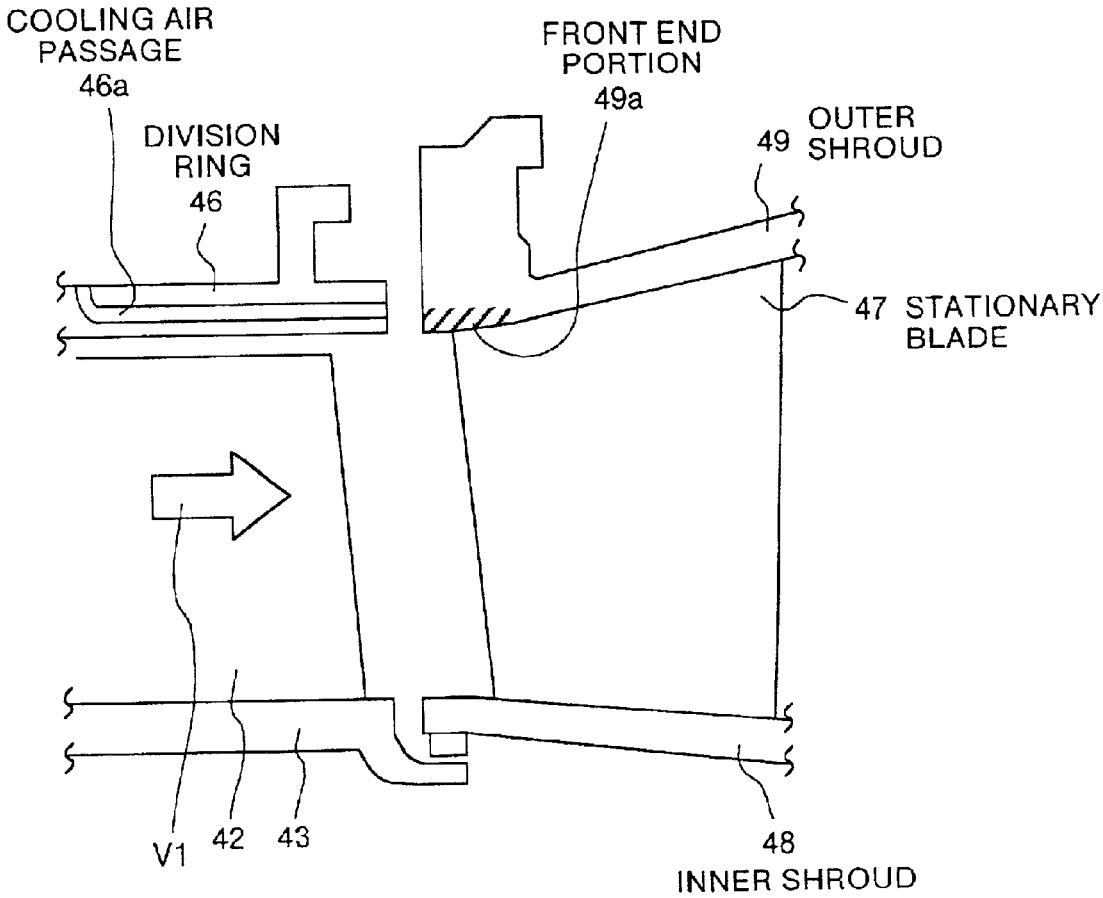
FIG. 11 is a view showing an outer shroud of a gas turbine according to the prior art.

In the above configuration, between side end surfaces 43*a* of the adjacent platforms 43, a predetermined gap 44 is formed in the manner generally shown in FIG. 10 so as to absorb heat expansion in the peripheral direction of the plat forms 43, and a sealing member 45 is provided across the side end surfaces 43*a* so as to prevent high temperature gas V1 flowing on the illustrated top surface of the platform 43 from leaking outside which is the illustrated bottom surface side.

The position where the sealing member 45 is provided across is the position in the roughly mid point between the illustrated top surface and the bottom surface of the platform 43 in the drawing, however, the sealing member 45 is not necessarily provided in this position but may be provided in the position nearer to the illustrated bottom surface of the platform 43. On the contrary, since a passage of cooling air (not shown) is formed in the position closer to the illustrated upper surface of the platform 43 (for example, see FIG. 4C), the sealing member will not be provided in the position close to the upper surface of the platform 43.

While the high temperature gas V1 in the moving blade member flows through the passage in the direction of the illustrated open arrow, the passage being surrounded by four surfaces, the blade surfaces of the opposite two moving blades 42, the platform 43 and the division ring (not shown) provided in the compartment while keeping a certain space between the tip end of the moving blade 42, part of the high temperature gas V2 (see FIG. 10) penetrates into the gap 44 from an opening 44*a* provided on the upstream side of flow of the above-mentioned gap 44, and directly passes through the gap 44 or passes thorough the gap 44 while flowing on the top surface of the platform 43 and being embraced by the gap 44.

While the surfaces to be exposed to the high temperature gas in the platform 43, moving blade 42 and the division ring are protected from the high temperature gas by being subjected to thermal barrier coating (TBC) or film cooling and the like, the side end surface 43*a* of the platform 43 which is a wall surface of the gap 44 is not subjected to such a treatment for improving heat resistance, or even if such a treatment is made, it is impossible to achieve a sufficient heat resisting effect by that treatment, with the result that there is a possibility that the side end surface 43*a* is burned by the high temperature gas V2 which penetrates from the upstream opening 44*a* into the gap 44 and flows through the gap 44 in the direction along the gap 44. Furthermore, also the high temperature gas V1 flowing on the top surface of the platform 43 might be embraced in the gap 44 to burn the side end surface 43*a* regardless of the position such as upstream position or downstream position of its flowing direction.

In view of the above, as shown in FIG. 2, the platform 43 of a gas turbine which is the first embodiment of the present invention is provided with the sealing member 45 which is made up of a plane portion as a sealing part, and a projection portion for filling the gap 44 and formed into a prism having a roughly T shape cross section as a whole.

Since the gap 44 between the platforms 43 are almost filled by providing the sealing member 45 thus formed, a part of the high temperature gas V1 is prevented from penetrating into the gap 44 from the opening 44*a* on the upstream side, with the result that it is possible to prevent the side end surface 43*a* of the platform 43 which is the wall surface of the gap 44 from being burned and to prolong the life-time and the maintenance interval. Furthermore, since the sealing member 45 lessens the gap 44, it is possible to prevent the high temperature gas V1 flowing on the platform 43 from being embraced and to prevent the side end surface 43*a* from being burned from this view point.

Furthermore, the sealing member 45 thus formed is useful in the case of producing anew gas turbine 10, however, it is also very useful in the point that it is applicable to an existent gas turbine 10 with low cost. In other words, though the sealing member 45 is replaced every predetermined maintenance period because it is a wear-and-tear item, it is possible to prolong the life-time and maintenance period of the existent gas turbine 10 only by replacing the cheep sealing member 45 without replacing the expensive unit of moving blade member including the platform 43.

In the first embodiment, it is preferable to blow cooling air into the gap still remaining between the sealing member 45 and the side end surface 43*a* of the platform 43, thereby further protecting the side end surface 43*a* of the platform 43.

Figure 3:
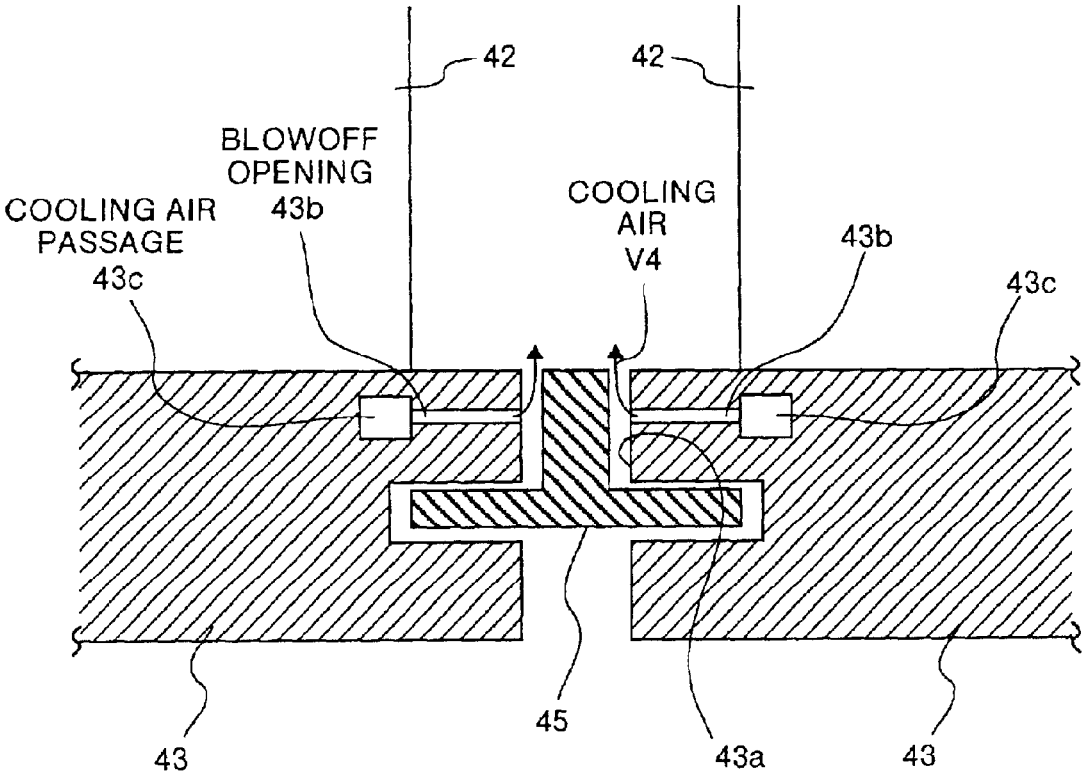
FIG. 3 is a view showing a cross section by the surface orthogonal to the extension direction of the gap in FIG. 2.

That is, as shown, for example, in the cross section of FIG. 3, while a cooling air passage 43*c* for allowing cooling air V4 to flow so as to cool the outer surface of the plat form 43 exposed to the high temperature gas V1 has been conventionally formed in the platform 43, a blowoff opening 43*b* for guiding a part of the cooling air V4 from the cooling air passage 43*c* to the side end surface 43*a* of the platform 43 may be formed and the side end surface 43*a* of the platform 43 may be cooled by the cooling air V4 blown from this blowoff opening 43*b*.

Blowing the cooling air V4 after lessening the gap 44 between the platforms 43 by means of the sealing member 45 in the manner as described above improves the efficiency of cooling the side end surfaces 43*a* significantly in comparison with the case where the cooling air V4 is blown in the condition that there is a large gap 44 as is the conventional case, and is very useful. Under the condition of wide gap 44, the heat capacity of the large space of the gap 44 is large, so that contribution for cooling the side end surface 43*a* is low, whereas, under the condition of narrow gap 44, the heat capacity of the space of the gap 44 is small. So that contribution for cooling the side end surface 43*a* is improved.

The configuration for blowing the cooling air into the gap still remaining between the sealing member 45 and the side end surfaces 43*a* of the platforms 43 is not limited to the form shown in FIG. 3, but other configurations can be applied.

For example, purge air V3 acting as a rear pressure of the sealing member 45 may be used as the cooling air. That is, while on the back side of the sealing member 45, the purge air V3 having higher pressure than the pressure of the high temperature gas V1 acts so as to prevent the high temperature V1 from leaking outside from the sealing member 45, and owing to this rear pressure, the sealing member 45 closely contacts with the wall surface of its arrangement groove to execute sealing function, it is possible to form a blowoff passage 45*a* in the close contact surface of the sealing member 45 for allowing a part of the purge air V3 to pass toward the side end surface 43*a* of the platform 43 as shown in FIG. 4C.

Figure 4A:
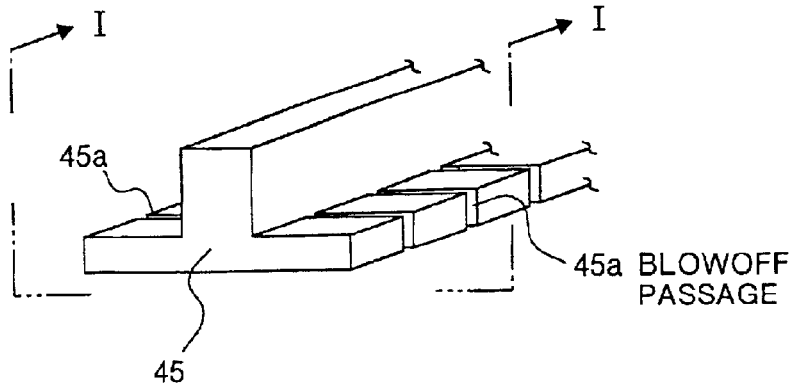
FIG. 4A to FIG. 4C are views showing a preferred embodiment of a sealing member.
Figure 4B:
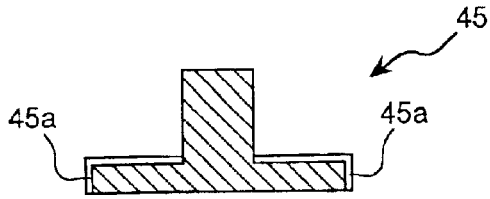
Figure 4C:
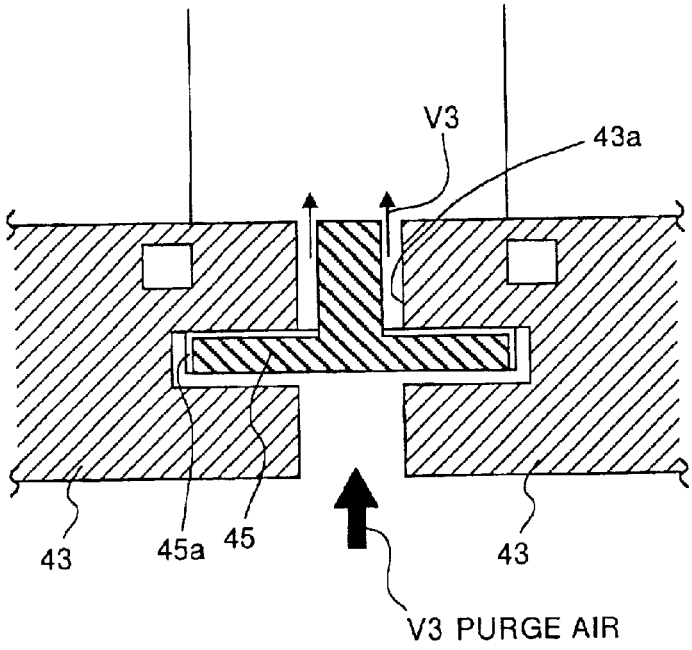

In connection with this, the sealing member 45 shown in FIG. 4A to FIG. 4C is more preferable than the embodiment shown in FIG. 3 in that it can provide more preferable cooling performance with respect to an existent gas turbine without additionally forming the blowoff opening 43*b* in the platform 43.

While the first embodiment relates to the platform 43 of the moving blade member, this embodiment similarly applies to a division wall section forming the passage wall for the high temperature gas V1, the division wall section connecting in plural in the arrangement direction of the blade to form a wall surface as a whole having a circular cross section, and also applies to the division ring provided in the compartment while interposing certain spaces between the outer shroud of the stationary blade, between the inner shroud of the stationary blade and between the tip end of the moving blade in the same manner as the first embodiment as described above.

Figure 5:
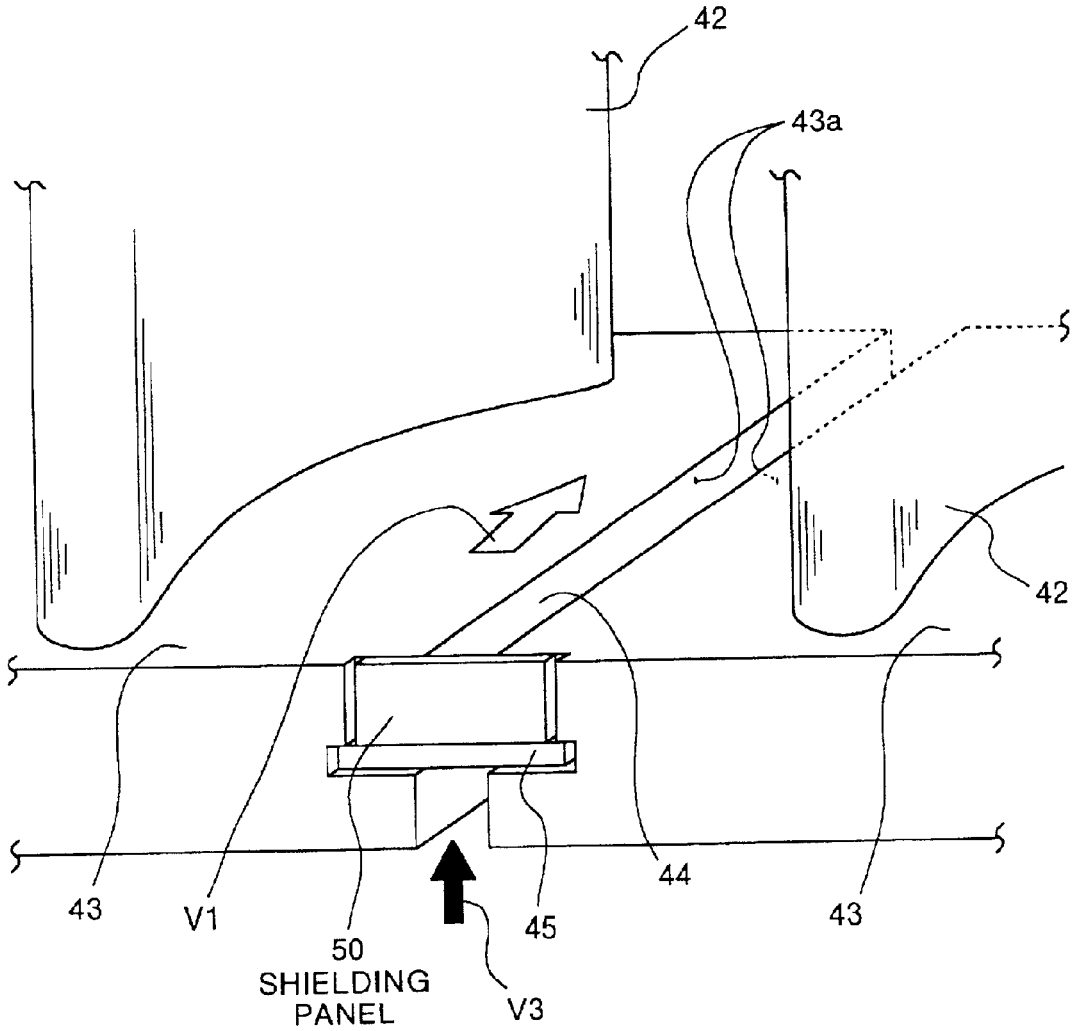
FIG. 5 is a view showing a platform which is a second embodiment of the present invention.

FIG. 5 is a perspective view of essential part showing a platform of a gas turbine which is a second embodiment of the present invention. This platform 43 is configured to have a shielding panel 50 for closing an opening on the upstream side of the high temperature gas V1 of the gap 44 formed between the connected platforms 43.

As illustrated, since the shielding panel 50 for closing an opening 44*a* (see FIG. 10) on the upstream side of the gap 44 prevents a part of the high temperature gas V1 from penetrating into the gap 44 from the opening 44*a* on the upstream side, it is possible to prevent the side end surfaces 43*a* of the platforms 43 which is a wall surface of the gap 44 from being burnt due to passage of the high temperature gas V1, so that it is possible to prolong the life-time and maintenance period of the turbine.

Figure 6:
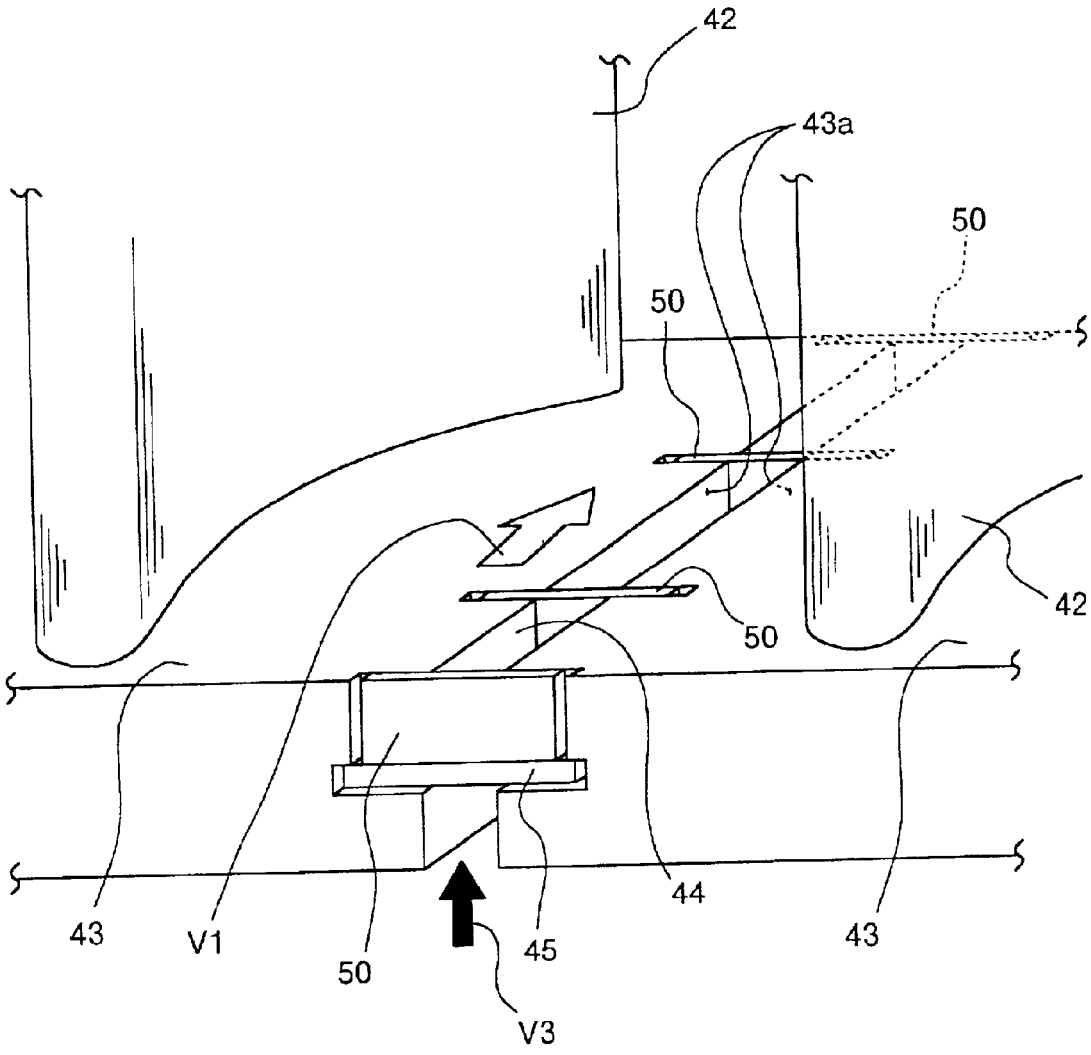
FIG. 6 is a view showing a platform in which a plurality of shielding panels are provided in FIG. 5.

While the shielding panel 50 essentially closes at least the opening 44*a* on the upstream side of the gap 44, the shielding panel 50 may be provided on the downstream side in the flow direction of the high temperature gas V1 as shown in FIG. 6.

Furthermore, similarly to the first embodiment as described above, it is preferred to form the blowoff opening 43*b* (see FIG. 3) for blowing the cooling air V4 in the side end surface 43*a* of the platform 43, or to provide the blowoff passage 45*a* (see FIG. 4A to FIG. 4C) for allowing the purge air V3 to pass through in the sealing member 45, thereby further protecting the side end surface 43*a* of the platform 43.

While the second embodiment relates to the platform 43 of the moving blade member, this embodiment similarly applies to a division wall section forming the passage wall for the high temperature gas V1, the division wall section connecting in plural in the arrangement direction of the blade to form a wall surface as a whole having a circular cross section, and also applies to the division ring provided in the compartment while interposing certain spaces between the outer shroud of the stationary blade, between the inner shroud of the stationary blade and between the tip end of the moving blade in the same manner as the second embodiment as described above.

Figure 7:
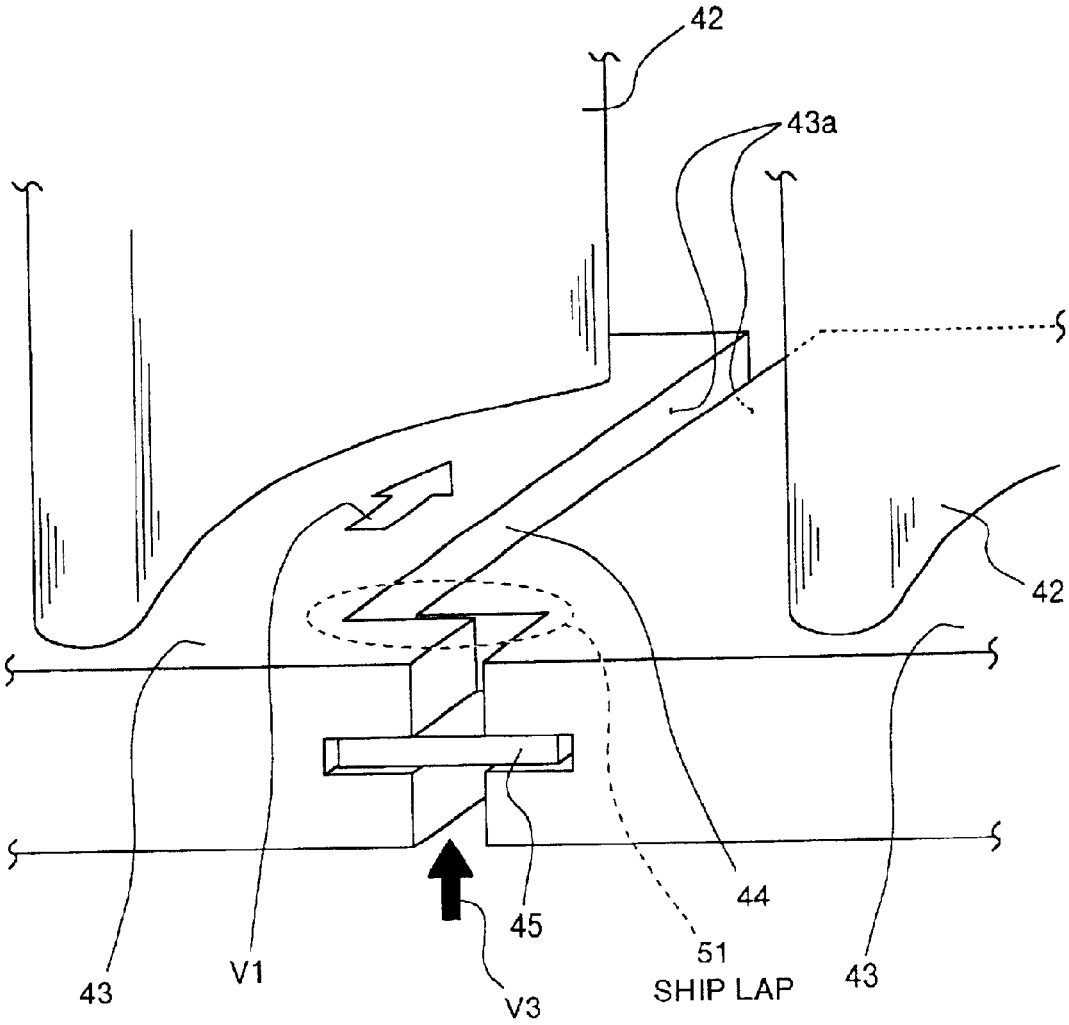
FIG. 7 is a view showing a platform which is a third embodiment of the present invention.

FIG. 7 is a perspective view of essential part showing a platform of a gas turbine which is a third embodiment of the present invention. This platform 43 is so configured that a ship lap 51 with respect to the flow direction of the high temperature gas V1 is formed on the upstream side of the high temperature gas V1 between the connected platforms 43.

As illustrated, by forming the ship lap 51 in the position close to the opening 44*a* on the upstream side of the gap 44 (see FIG. 10), a part of high temperature gas V1 having penetrated into the gap from the opening 44*a* on the upstream side is prevented from further advancing in the gap 44 of high temperature gas V1 because the gap 44 is closed by the ship lap 51, with the result that it is possible to prevent the side end surface 43*a* of the platform 43 which is a wall surface of the gap 44 from being burned due to passage of the high temperature gas V1 and hence it is possible to prolong the life-time and the maintenance period of the turbine.

Figure 8:
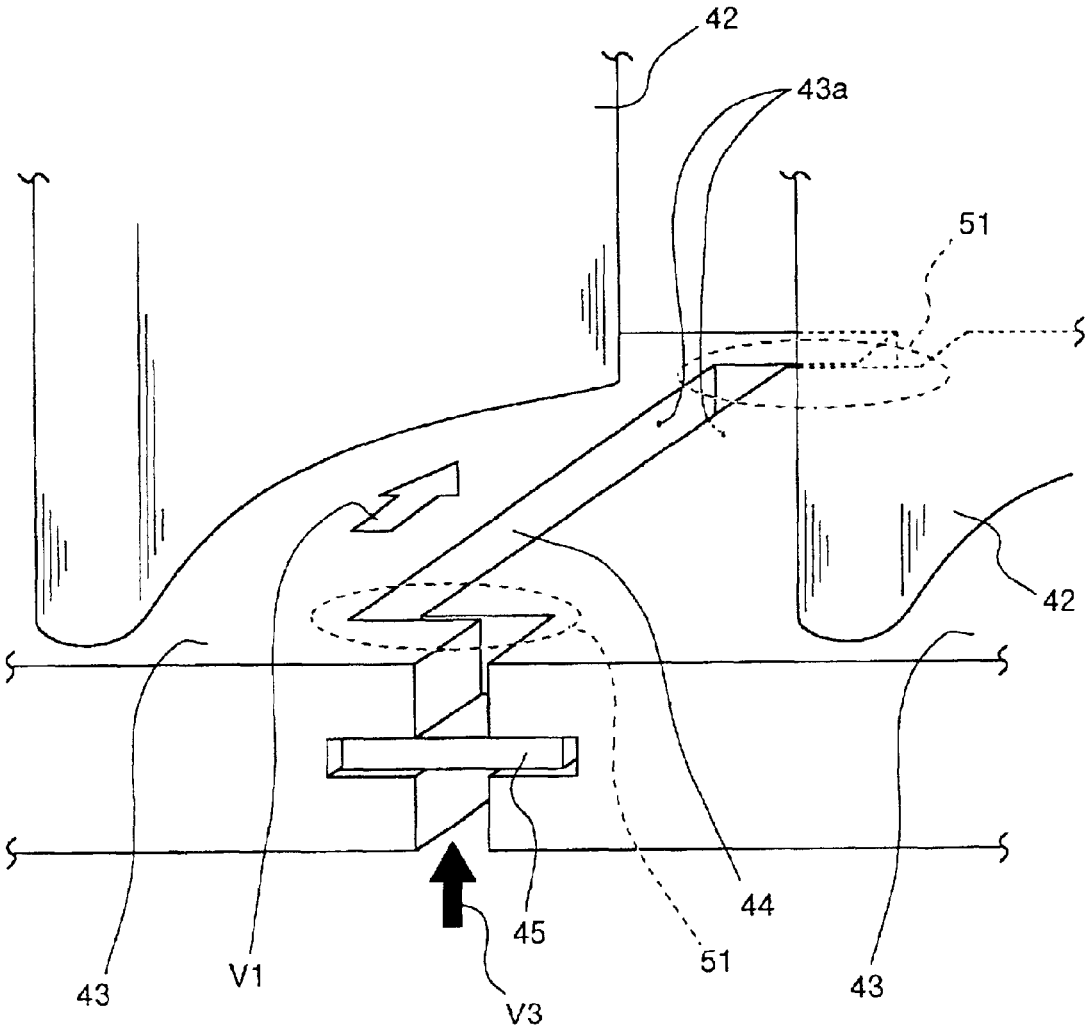
FIG. 8 is a view showing a platform in which two ship flaps are provided in FIG. 7.

While the ship lap 51 is essentially formed in the position close to the opening 44*a* on the upstream side of the gap 44, the ship lap 51 may be formed also on the downstream side of the flow direction of the high temperature gas V1 as shown in FIG. 8.

Furthermore, similarly to the first embodiment as described above, it is preferred to form the blowoff opening 43*b* (see FIG. 3) for blowing the cooling air V4 in the side end surface 43*a* of the platform 43, or to provide the blowoff passage 45*a* (see FIG. 4A to FIG. 4C) for allowing the purge air V3 to pass through in the sealing member 45, thereby further protecting the side end surface 43*a* of the platform 43.

While the third embodiment relates to the platform 43 of the moving blade member, this embodiment similarly applies to a division wall section forming the passage wall for the high temperature gas V1, the division wall section connecting in plural in the arrangement direction of the blade to form a wall surface as a whole having a circular cross section, and also applies to the division ring provided in the compartment while interposing certain spaces between the outer shroud of the stationary blade, between the inner shroud of the stationary blade and between the tip end of the moving blade in the same manner as the third embodiment as described above.

Figure 9A:
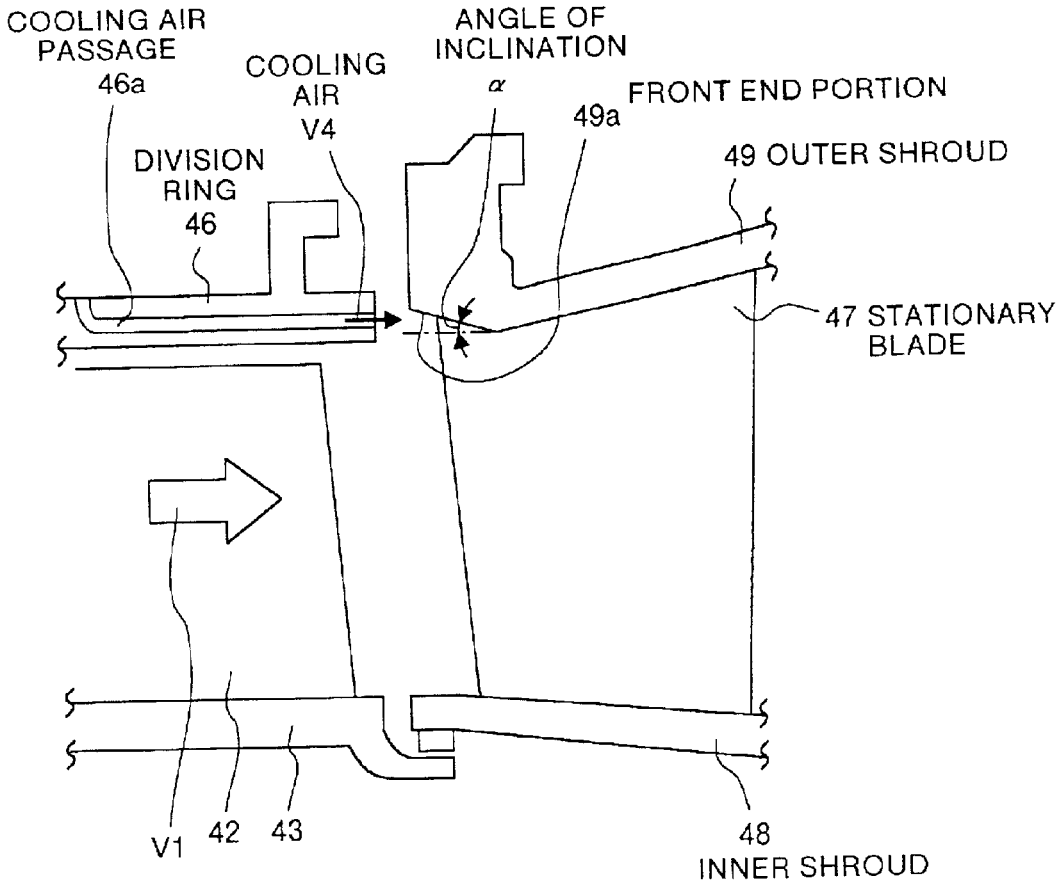
FIG. 9A and FIG. 9B are views showing an outer shroud which is a fourth embodiment of the present invention.
Figure 9B:
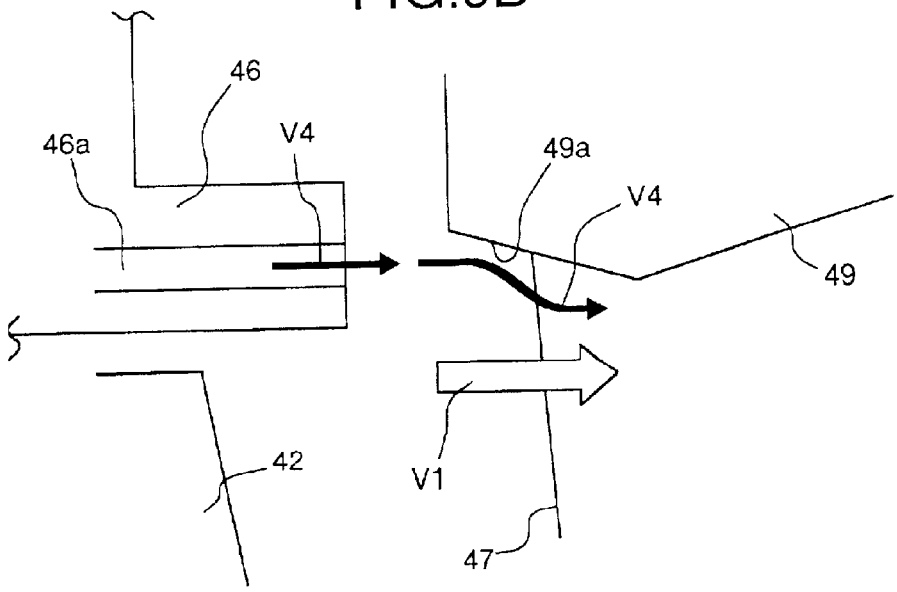

FIG. 9A and FIG. 9B are section views of an essential part showing an outer shroud of a gas turbine which is a fourth embodiment relating to a shroud of a gas turbine according to the present invention. This shroud 49 is an outer shroud of a stationary blade 47 provided on the back side of the moving blade 42 of the turbine in which a division ring 46 is provided in a compartment while interposing a certain gap between the tip end of the moving blade 42 of the turbine. In the division ring 46, a cooling air passage 46*a* through which the cooling air V4 for cooling the division ring 46 passes is formed, and a front end portion 49*a* opposing to the opening on the back side of the cooling air passage 46*a* is formed at an angle so that the cooling air V4 blown from the opening forms an air film at the front end portion 49*a*.

In the manner as described above, according to the shroud 49 in which the front end portion 49*a* is formed at an angle, since the cooling air V4 blown from the rear end opening of the cooling air passage 46*a* of the division ring 46 flows along the front end portion 49*a* of the shroud 49 to form a protecting film at the front end portion 49*a*, it is possible to achieve protection from high heat of the high temperature gas V1 flowing from the moving blade 42 and suppress burning.

As described above, according to the division wall of a gas turbine of one aspect of the present invention, since the gas flow restricting structure prevents the high temperature gas from passing through the gap formed at the connecting portion between the division wall sections in the flow direction of the high temperature gas from the opening on the upstream of the high temperature gas, and prevents the high temperature gas from embraced in the gap, it is possible to prevent a side end surface of the division wall section which is a sidewall of the gap from being burned. Furthermore, since the gas flow restricting structure prevents the high temperature gas from being embraced in the gap formed at the connecting portion between the division wall sections regardless of the position in the flow direction of the high temperature gas, it is possible to prevent a side end surface of the division wall section which is a side wall of the gap from being burned.

In the above-mentioned division wall, since the gas flow restricting structure prevents the high temperature gas from passing through the gap formed at the connecting portion between the divided individual shrouds in the flow direction of the high temperature gas from the opening on the upstream of the high temperature gas, and prevents the high temperature gas from embraced in the gap, it is possible to prevent a side end surface of the individual shroud which is a side wall of the gap from being burned. Furthermore, since the gas flow restricting structure prevents the high temperature gas from being embraced in the gap regardless of the position in the flow direction of the high temperature gas, it is possible to prevent a side end surface of the division wall section which is a side wall of the gap from being burned.

In the above-mentioned division wall, since the gas flow restricting structure prevents the high temperature gas from passing through the gap formed at the connecting portion between the divided individual platforms in the flow direction of the high temperature gas from the opening on the upstream of the high temperature gas, and prevents the high temperature gas from embraced in the gap, it is possible to prevent a side end surface of the individual platform which is a side wall of the gap from being burned. Furthermore, since the gas flow restricting structure prevents the high temperature gas from being embraced in the gap regardless of the position in the flow direction of the high temperature gas, it is possible to prevent a side end surface of the division wall section which is a side wall of the gap from being burned.

In the above-mentioned division, since the gas flow restricting structure prevents the high temperature gas from passing through the gap formed at the connecting portion between the divided individual division rings in the flow direction of the high temperature gas from the opening on the upstream of the high temperature gas, and prevents the high temperature gas from embraced in the gap, it is possible to prevent a side end surface of the individual division ring which is a side wall of the gap from being burned. Furthermore, since the gas flow restricting structure prevents the high temperature gas from being embraced in the gap regardless of the position in the flow direction of the high temperature gas, it is possible to prevent a side end surface of the division wall section which is a side wall of the gap from being burned.

In the above-mentioned division wall, since the sealing member is formed into a projection shape filling the gap, this projection shape portion of the sealing member prevents the high temperature gas from passing through the gap in the flow direction of the high temperature gas from the opening on the upstream side of the high temperature gas, so that it is possible to prevent a side end surface of the individual division wall section which is a side wall of the gap from being burned. Furthermore, since the projection-shape portion of the sealing member lessens the gap, it is possible to prevent the high temperature from being embraced in the gap regardless of the position in the flow direction of the high temperature gas, so that it is possible prevent the burning more efficiency.

In the above-mentioned division wall, since the shielding panel closes the opening on the upstream side of the high temperature gas in the gap, and this projection shape portion of the sealing member prevents the high temperature gas from passing through the gap in the flow direction of the high temperature gas from the opening on the upstream side of the high temperature gas, it is possible to prevent a side end surface of the individual division wall section which is a sidewall of the gap from being burned.

In the above-mentioned division wall, since the ship lap formed on the upstream side of the high temperature gas prevents the high temperature gas from further advancing in the gap even if the high temperature gas enters the gap from the opening on the upstream side of the high temperature, it is possible to prevent a side end surface of the individual division wall section which is a side wall of the gap from being burned.

In the above-mentioned division wall, by making the cooling air blowoff structure blow the cooling air into the gap, the gap is cooled, so that it is possible to further suppress the burning.

In the above-mentioned division wall, by blowing the cooling air into the gap from the blowoff opening formed in the side wall surface of the gap, the gap is cooled, so that it is possible to further suppress the burning.

In the above-mentioned division wall, by blowing the cooling air into the gap from the blowoff opening formed in the sealing member, the gap is cooled, so that it is possible to further suppress the burning.

According to the shroud of a gas turbine of another aspect of the present invention, since the front end portion of the shroud is formed at an angle, the cooling air discharged from the opening of the cooling air passage of the division ring will not come into collision with the front end portion of the shroud but flow along the inclined front end portion of the shroud to form a protecting film at this front end portion, thereby protecting from the heat of the high temperature gas and preventing burning.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A wall of a gas turbine, comprising:

a plurality of wall sections connected in the direction of a set of blades in the gas turbine and forming a wall surface having a substantially circular cross section, the wall sections being fixed to an outer end or an inner end of the set of blades in the gas turbine, or being positioned to interpose a predetermined space between the outer end of the set of blades and forming a passage wall for high temperature gas together with a blade surface of the respective blade; and a plurality of gas flow restricting devices positioned in gaps formed between the wall sections, respectively, and configured to restrict the high temperature gas from flowing in the gaps along axial and radial directions of the gas turbine, wherein the plurality of wall sections have side end wall surfaces in the gaps, and the side end wall surfaces have blowoff openings for blowing cooling air into the gaps.

2. The wall according to claim 1, wherein the set of blades comprises a plurality of stationary blades and the wall is a shroud.

3. The wall according to claim 1, wherein the set of blades comprises a plurality of moving blades and the wall is a platform.

4. The wall according to claim 1, wherein the set of blades comprises a plurality of moving blades and the wall is a ring wall provided in a compartment and interposing the predetermined space from tip ends of the moving blades.

5. The wall according to claim 1, wherein the plurality of gas flow restricting devices comprises a plurality of sealing devices each having a projection portion configured to fill a respective one of the gaps so as to prevent the high temperature gas from leaking outside the passage wall.

6. The wall according to claim 1, wherein the plurality of gas flow restricting comprises a plurality of shielding panels positioned to close end openings on the upstream side of the high temperature gas in the gaps, respectively.

7. The wall according to claim 1, further comprising a plurality of cooling air blowoff devices configured to blow cooling air into the gaps, respectively, wherein the plurality of cooling air blowoff devices comprises a plurality of blowoff passages formed in the sealing members, respectively.

8. A wall of a gas turbine, comprising:

a plurality of wall sections connected to form a wall body having a substantially circular cross section, the wall sections fixing an outer end or an inner end of a set of blades thereon, or being positioned to interpose a predetermined space between the outer end of the set of blades and forming a passage wall for high temperature gas; and a gas flow restricting device provided in fans formed between the wall sections, respectively, and configured to restrict the high temperature gas from flowing in the gaps along axial and radial directions of the gas turbine, wherein the plurality of wall sections have side end wall surfaces in the gaps, and the side end wall surfaces have blowoff openings for blowing cooling air into the gaps.

* * * * *